US009868624B2

(12) United States Patent
Ahern et al.

(10) Patent No.: US 9,868,624 B2
(45) Date of Patent: Jan. 16, 2018

(54) METHOD AND SYSTEM FOR A HYDRAULIC CYLINDER

(71) Applicant: Xtreme Manufacturing, LLC, Las Vegas, NV (US)

(72) Inventors: Don Francis Ahern, Las Vegas, NV (US); Ronald Lee Fifield, Las Vegas, NV (US)

(73) Assignee: Xtreme Manufacturing, LLC, Las Vegas, NV (US)

( * ) Notice: Subject to any disclaimer, the term of this patent is extended or adjusted under 35 U.S.C. 154(b) by 0 days.

(21) Appl. No.: 14/195,387

(22) Filed: Mar. 3, 2014

(65) Prior Publication Data

US 2015/0247494 A1 Sep. 3, 2015

(51) Int. Cl.
*F04B 17/03* (2006.01)
*B66F 11/04* (2006.01)

(52) U.S. Cl.
CPC ..... *B66F 11/042* (2013.01); *F04B 17/03* (2013.01)

(58) Field of Classification Search
CPC ... F16D 31/02; F04B 41/02; F16J 1/12; F15B 15/149; F15B 15/1466; F15B 15/1471
See application file for complete search history.

(56) References Cited

U.S. PATENT DOCUMENTS 3,554,525 A * 1/1971 De Koning ..... B60G 17/044 267/64.17
4,368,878 A * 1/1983 Meller ..... B60G 17/044 267/64.17
4,403,680 A * 9/1983 Hillesheimer ..... B66F 7/065 177/146
4,618,306 A * 10/1986 Dorsch ..... B66F 9/19 335/285
4,890,692 A 1/1990 Oakman
5,295,563 A * 3/1994 Bennett ..... B60G 17/0152 188/266.2
5,372,223 A * 12/1994 DeKock ..... F16F 9/465 188/282.5

(Continued)

FOREIGN PATENT DOCUMENTS

JP 2002060188 A 2/2002
JP 2010101446 A 5/2010

OTHER PUBLICATIONS

International Search Report and Written Opinion, dated Jun. 12, 2015, for co-pending International application No. PCT/US2015/017675 (16 pgs.).

(Continued)

*Primary Examiner* — Katherine Mitchell
*Assistant Examiner* — Shiref Mekhaeil
(74) *Attorney, Agent, or Firm* — Armstrong Teasdale LLP

(57) ABSTRACT

A system and method of operating a scissors lift assembly are provided. The system includes a hollow piston rod including an internal fluid reservoir, a cylinder body that is coaxial with and at least partially surrounding the hollow piston rod, and a fluid pump in flow communication with the reservoir through a suction channel extending from the internal fluid reservoir though a transfer tube to a suction port of the fluid pump. The transfer tube is coaxial with the piston, the piston rod, and the cylinder body and a discharge port of the fluid pump is in flow communication with an extension pressure chamber.

19 Claims, 7 Drawing Sheets

(56) References Cited

U.S. PATENT DOCUMENTS 5,423,402 A * 6/1995 de Kock ..... F16F 9/46 188/275
5,755,099 A * 5/1998 Hung ..... B66F 5/04 60/479
5,890,568 A * 4/1999 De Kock ..... F16F 9/512 188/266.5
5,937,647 A * 8/1999 Hung ..... B66F 5/04 254/93 H
6,282,893 B1 9/2001 Porter et al.
6,883,641 B2 4/2005 Julien
7,021,434 B2 * 4/2006 Beck ..... B60G 17/044 188/297
7,104,052 B1 * 9/2006 Hindman ..... A01D 34/246 60/413
8,332,089 B2 12/2012 Nakazawa
2005/0210873 A1 * 9/2005 Tanaka ..... B60K 17/105 60/485
2005/0235730 A1 * 10/2005 Brailovskiy ..... B25F 5/005 72/453.16
2006/0054016 A1 * 3/2006 Davies ..... F15B 15/1409 92/109
2006/0151252 A1 7/2006 Joos
2006/0225955 A1 10/2006 Murphy
2007/0209357 A1 * 9/2007 Sato ..... F15B 1/265 60/476
2007/0221457 A1 * 9/2007 Schmitz ..... F16F 9/5126 188/266
2008/0022462 A1 * 1/2008 Benson ..... B25B 21/02 7/100
2008/0190104 A1 8/2008 Bresie
2008/0308358 A1 * 12/2008 Zuercher ..... B66B 9/0807 187/200
2009/0038897 A1 * 2/2009 Murakami ..... F16F 9/3482 188/266.5
2011/0024957 A1 * 2/2011 Nagai ..... B60G 17/08 267/34
2011/0146262 A1 * 6/2011 Schmidt ..... F15B 15/1447 60/473
2011/0227301 A1 * 9/2011 Nagai ..... B60G 17/0272 280/6.157
2013/0213744 A1 8/2013 Foley

OTHER PUBLICATIONS

Extended European Search Report, dated Sep. 27, 2017, for co-pending EP patent application No. EP15758225.5 (7 pgs).

* cited by examiner

METHOD AND SYSTEM FOR A HYDRAULIC CYLINDER

BACKGROUND

This description relates to fluid piston-cylinders, and, more particularly, to a method and system for a fluid piston-cylinder assembly having an internal fluid reservoir.

Hydraulic power systems often use piston-cylinders to apply a linear force where needed. Typically, a piston-cylinder includes a cylindrically shaped body having a bore through a longitudinal axis of the body. One end of the cylinder is closed by a base end and a rod end is open to receive a piston and rod assembly. When a high pressure fluid, such as, hydraulic oil is introduced into the space between the base end and the piston, a force is imparted to the rod through the piston. The rod is generally coupled to a load, which is then manipulated by the force transmitted through the rod. The hydraulic oil is introduced through one or more hydraulic hoses or tubes connecting the space between the base end and the piston to a source of high pressure hydraulic oil, for example, a hydraulic pump coupled to a reservoir. Because the hydraulic pump may serve several loads, the hydraulic pump is often large and consequently positioned away from the loads. Also, because the loads are often in relatively less accessible locations, the hydraulic pump is located in a more accessible area, which is remote from the loads. Accordingly, to supply high pressure fluid to the space between the base end and the piston for each of the piston-cylinders associated with the loads, the piston-cylinders are connected to the hydraulic pump through long runs of hydraulic piping, tubing, and/or hoses. Over time, such piping, tubing, and hoses tend to develop leaks, which are an environmental concern and impact personnel safety.

BRIEF DESCRIPTION

In one embodiment, a fluid cylinder assembly includes a hollow piston including an internal fluid reservoir, a cylinder body that is coaxial with and at least partially surrounding the hollow piston, and a fluid pump in flow communication with the reservoir through a suction channel extending from the internal fluid reservoir though a transfer tube to a suction port of the fluid pump. The transfer tube is coaxial with the piston and the cylinder body and a discharge port of the fluid pump is in flow communication with an extension pressure chamber.

In another embodiment, a method of operating a scissors lift assembly includes providing a scissors lift assembly including a work platform, a plurality of linked, folding supports oriented in a crisscross pattern and a fluid cylinder assembly configured to apply a force to a set of the linkages to raise the work platform. The method also includes supplying a variable rate of a flow of a fluid to an extension pressure chamber of the fluid cylinder assembly from a reservoir internal to a piston using a variable speed fluid pump integral to the fluid cylinder assembly wherein the rate of the flow of the fluid is relative to a selectable speed of the fluid pump and the rate of the flow of the fluid to the piston defines a speed of raising the work platform. The method further includes selecting the speed of the fluid pump using a variable input device.

In yet another embodiment, a method of operating a fluid piston-cylinder assembly includes extracting fluid from a reservoir of fluid within an interior volume of a piston, the piston slidably engaged to an interior surface of a cylinder, increasing a pressure of the extracted fluid, channeling the fluid to an extension pressure chamber within the cylinder, and translating the piston axially in the cylinder using the channeled fluid.

BRIEF DESCRIPTION OF THE DRAWINGS

FIG. 1 is a side elevation view of a mobile scissors lift vehicle in accordance with an example embodiment of the present disclosure.

FIG. 2 is a cut-away cross-sectional view of a fluid cylinder assembly 200 in accordance with an example embodiment of the present disclosure.

FIG. 3 is a schematic diagram of a fluid flow circuit within fluid cylinder assembly shown in FIG. 2.

FIG. 4 is a side view of the fluid cylinder assembly shown in FIG. 2 in a retracted position.

FIG. 5 is a plan view of the fluid cylinder assembly shown in FIG. 2 in an extended position.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to embodiments of piston cylinder power transmission devices in industrial, commercial, and residential applications.

The following description refers to the accompanying drawings, in which, in the absence of a contrary representation, the same numbers in different drawings represent similar elements.

Figure 1:
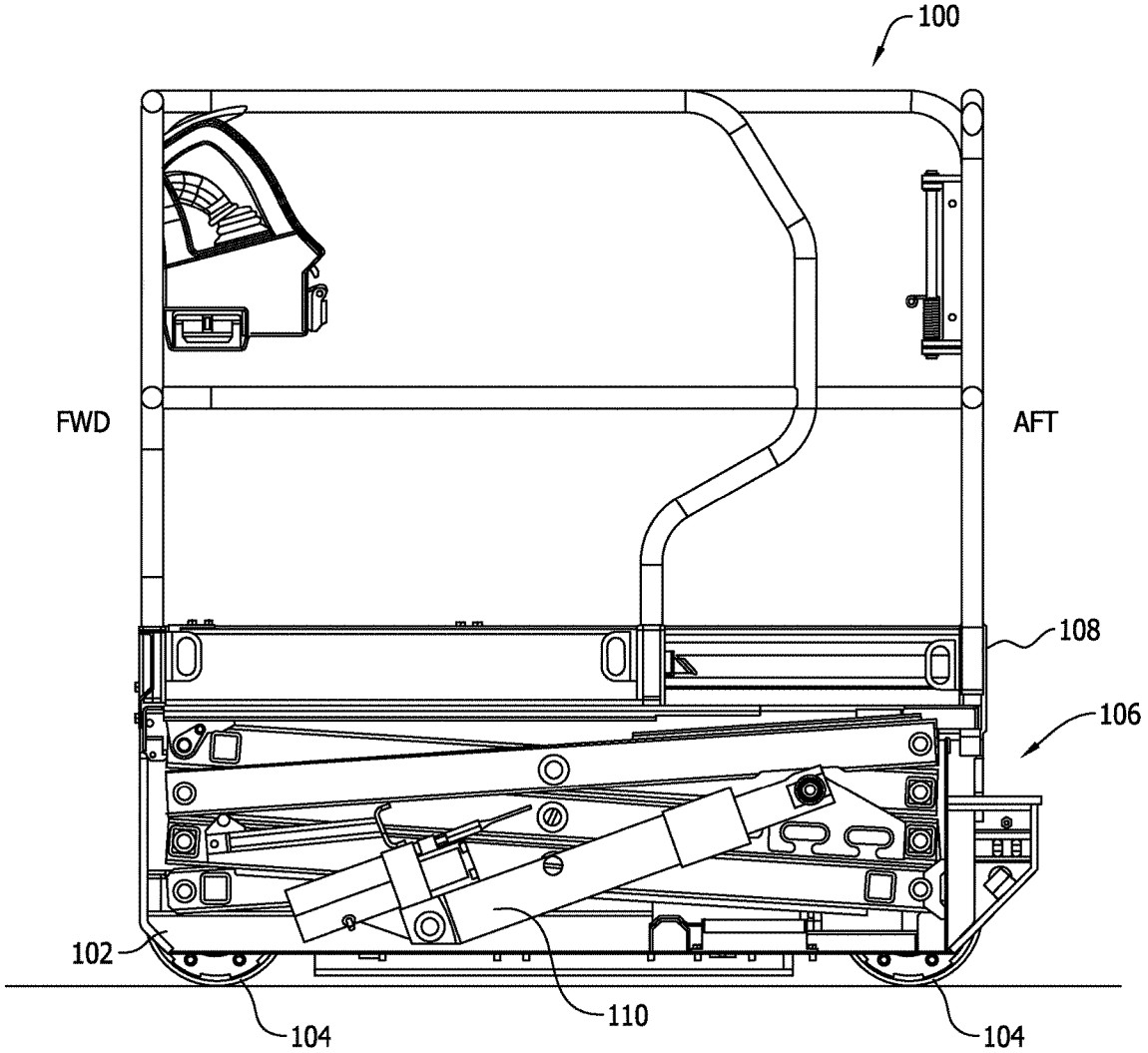
FIGS. 1-5 show example embodiments of the method and apparatus described herein.

FIG. 1 is a side elevation view of a mobile scissors lift vehicle 100 in accordance with an example embodiment of the present disclosure. In the example embodiment, scissors lift vehicle 100 includes a chassis 102 supported by wheels 104. A scissors stack 106 is mounted on top of chassis 102 and a work platform 108 is mounted on top of scissors stack 106. Scissors stack 106 includes a plurality of linked, folding supports oriented in a crisscross or "X" pattern. Upward motion of work platform 108 is achieved by the application of a force to a set of parallel scissors linkages, elongating the crossing pattern, and propelling the work platform vertically. The force is generated by a fluid cylinder assembly 110 coupled between, for example, chassis 102 and a set of scissors linkages. In various embodiments, fluid cylinder assembly 110 is coupled between other structure of scissors lift vehicle 100 than chassis 102 and the set of scissors linkages.

Figure 2:
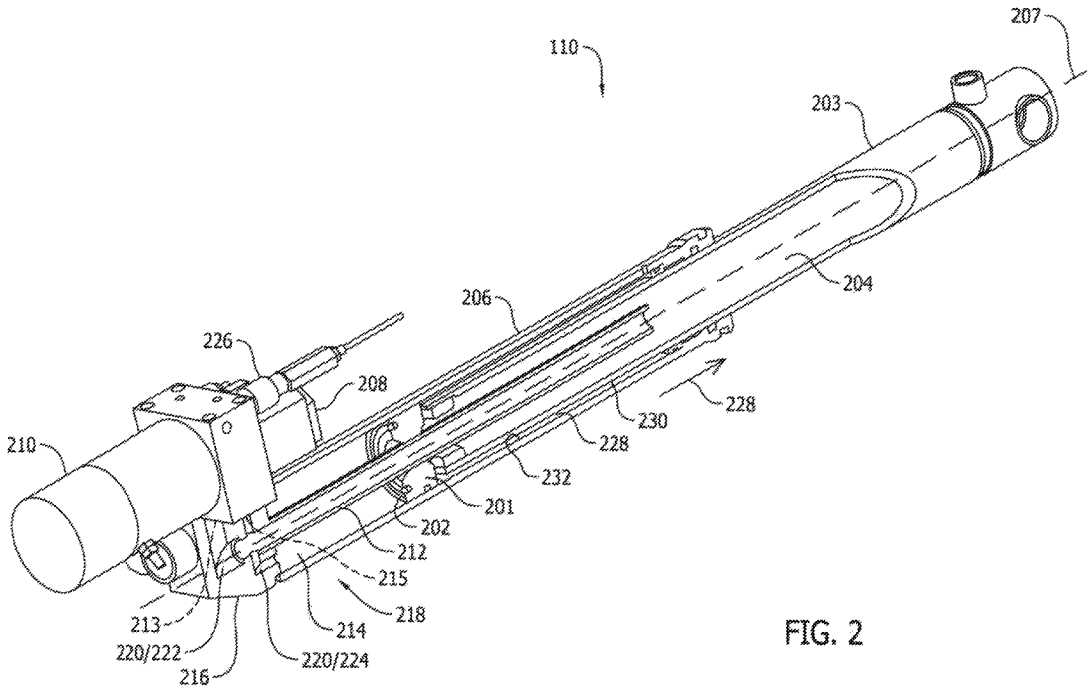

FIG. 2 is a cut-away cross-sectional view of a fluid cylinder assembly 200 in accordance with an example embodiment of the present disclosure. In the example embodiment, fluid cylinder assembly 200 includes a piston 201 having a piston face 202, a hollow piston rod 203, and an internal fluid reservoir 204. Fluid cylinder assembly 200 also includes a cylinder body 206 coaxial along axis 207 with and at least partially surrounding hollow piston rod 203. A fluid pump 208 driven by a variable speed motor 210 is in flow communication with reservoir 204 through a transfer tube 212 extending from internal fluid reservoir 204 to a suction port 213 of fluid pump 208. A discharge port 215 of fluid pump 208 is in flow communication with an extension pressure chamber 214 defined radially between transfer tube 212 and cylinder body 206. A valve block 216 is coupled to a first end 218 of cylinder body 206 and includes one or more fluid channels 220 formed therein. At least one of channels 220 is a pump suction channel 222 extending between transfer tube 212 and suction port 213 of fluid pump 208. At least one other of channels 220 is a pump discharge channel 224 extending between discharge port 215 of fluid pump 208 and extension pressure chamber 214. Pump discharge channel 224 further includes a check valve (not shown in FIG. 1). Pump discharge channel 224 also includes a return path 225 including a pressure relief valve (not shown in FIG. 1). In the example embodiment, the check valve and pressure relief valve are formed together is a single pressure relief assembly 226. In various embodiments, fluid reservoir 204 includes a space 228 between an outer surface 230 of rod 203 and an inner surface 232 of cylinder body 206.

During operation, to extend fluid cylinder assembly 200, fluid is pumped from internal fluid reservoir 204 through transfer tube 212, pump suction channel 222, and suction port 213 of fluid pump 208. Fluid pump 208 discharges the fluid through pump discharge channel 224 and the check valve into extension pressure chamber 214. The relatively high differential pressure between extension pressure chamber 214 and internal fluid reservoir 204 applies a driving force to piston face 202 causing piston 201 to move in an extension direction 234. A speed of extension of fluid cylinder assembly 200 is relative to a speed of fluid pump 208, which is variable over a predetermined operating range.

Retraction of fluid cylinder assembly 200 is by gravity when a lowering valve is opened to channel fluid through an orificed metering valve and the lowering valve and back to internal fluid reservoir 204.

Figure 3:
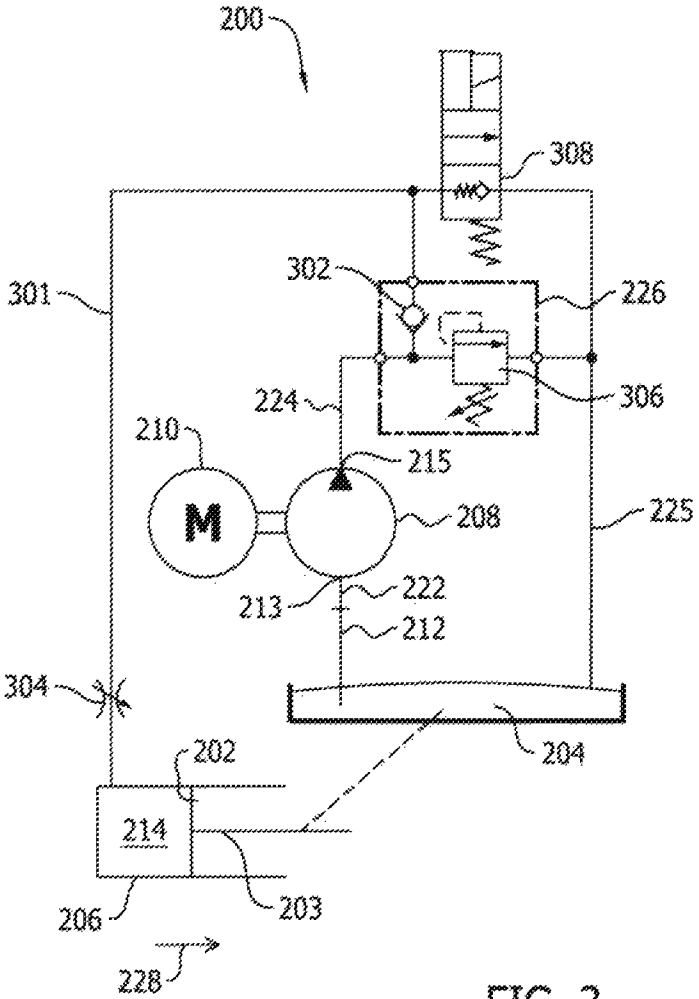

FIG. 3 is a schematic diagram of a fluid flow circuit 300 within fluid cylinder assembly 200 (shown in FIG. 2). In the example embodiment, when commanded to raise work platform 108, fluid is supplied at a variable rate from reservoir 204 through an extension pressure chamber supply path 301 including pump 208, a check valve 302, and an orifice 304 to extension pressure chamber 214. Because motor 210 is variable speed and directly coupled to pump 208, a rate of pumping of fluid through pump 208 is controlled by the speed of motor 210. Excess pressure above a predetermined limit is bypassed back to reservoir 204 through a pressure relief valve 306, which may be operated when pressure from pump 208 causes a ball check valve to overcome a spring bias to lift the ball and opening pressure relief valve 306.

When commanded to lower work platform 108, a normally closed lowering valve 308 is opened using a solenoid to bleed fluid from extension pressure chamber 214 through orifice 304 and lowering valve 308 to reservoir 204. Orifice 304 may be fixed or may be variable to permit adjustment of a lowering speed of work platform 108. If variable, orifice 304 is adjusted to control a speed at which work platform 108 is able to lower by controlling a rate that the fluid is permitted to bleed back to reservoir 204.

Figure 4:
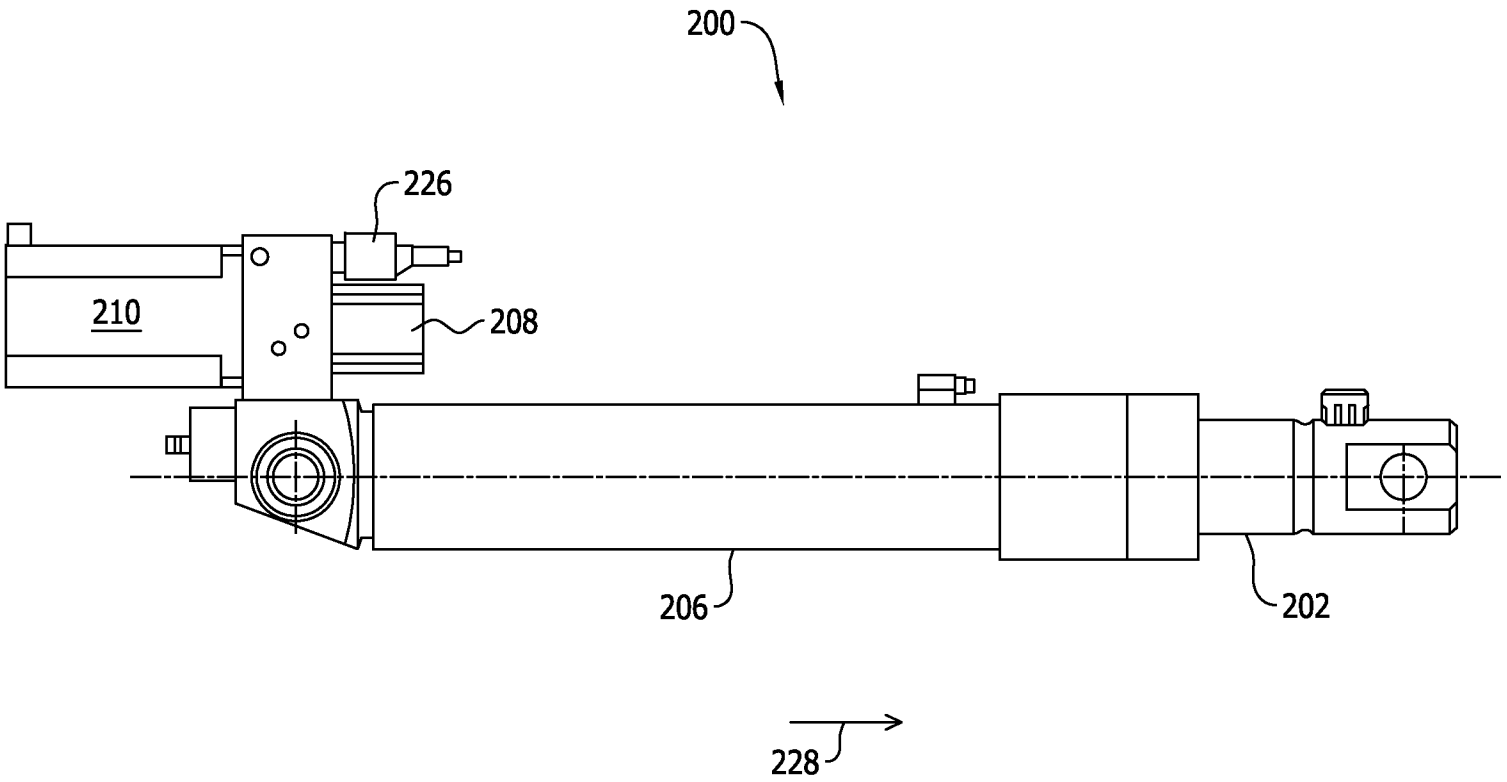
Figure 5:
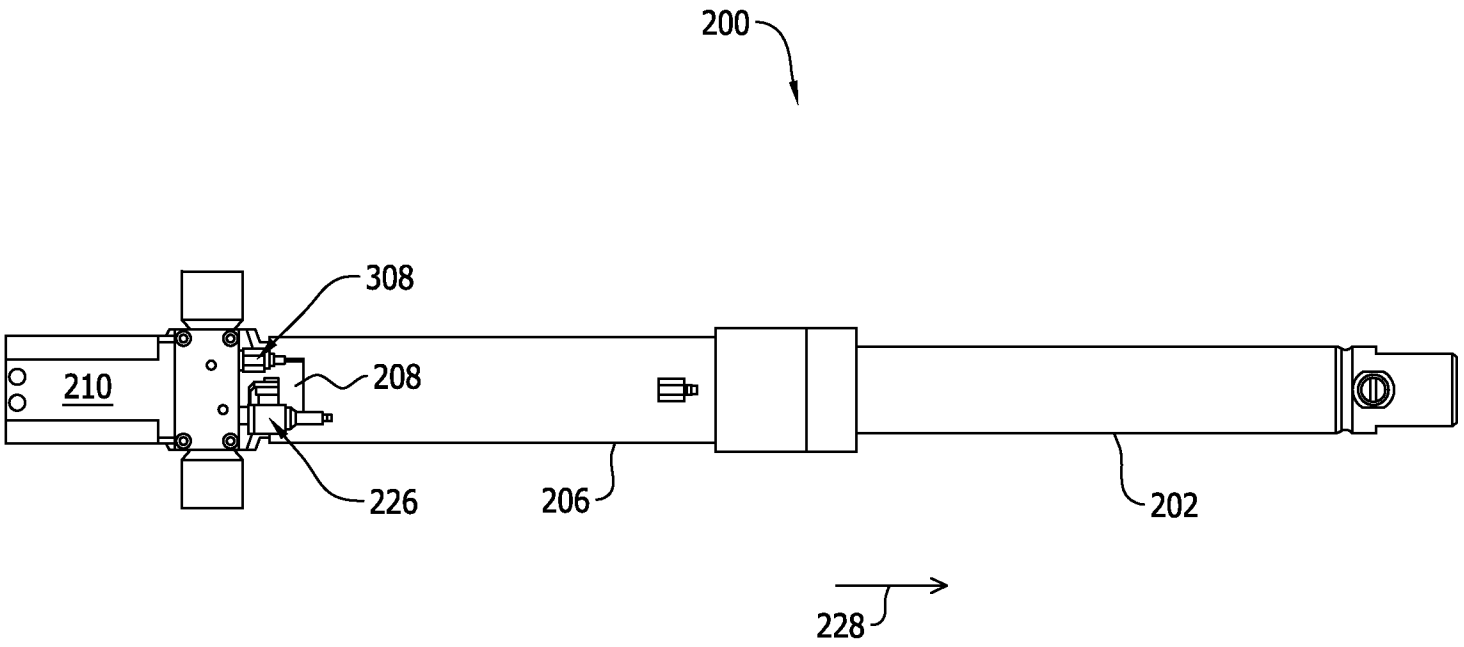

FIG. 4 is a side view of fluid cylinder assembly 200 (shown in FIG. 2) in a retracted position. FIG. 5 is a plan view of fluid cylinder assembly 200 (shown in FIG. 2) in an extended position.

Figure 6:
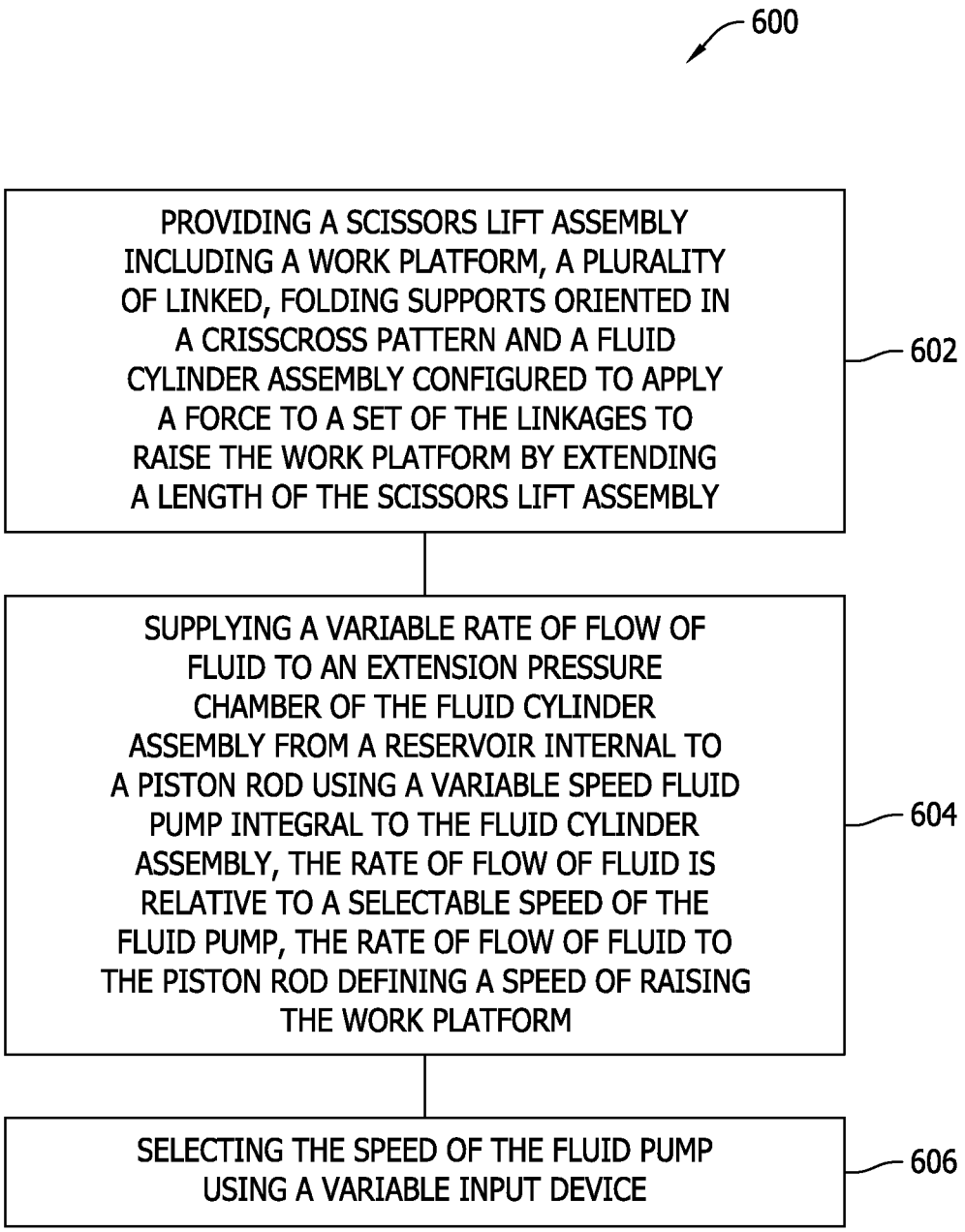
FIG. 6 is a flow diagram of a method of operating a scissors lift assembly in accordance with an example embodiment of the present disclosure.

FIG. 6 is a flow diagram of a method 600 of operating a scissors lift assembly. In the example embodiment, the scissors lift assembly includes providing 602 a scissors lift assembly including a work platform, a plurality of linked, folding supports oriented in a crisscross pattern and a fluid cylinder assembly configured to apply a force to a set of the linkages to raise the work platform by extending a length of the scissors lift assembly, supplying 604 a variable rate of fluid flow to an extension pressure chamber of the fluid cylinder assembly from a reservoir internal to a piston using a variable speed fluid pump integral to the fluid cylinder assembly, the rate of fluid flow is relative to a selectable speed of the fluid pump, the rate of fluid flow to the piston defining a speed of raising the work platform, and selecting 606 the speed of the fluid pump using a variable input device. Optionally, method 600 also includes bleeding fluid from the piston to the reservoir through a selectable size orifice to lower the work platform. Method 600 also optionally includes controlling the speed of the bleeding using the selectable size orifice. Method 600 further optionally includes generating a fluid pump speed command signal using a joystick control. Method 600 also optionally includes selecting a speed of an electric motor coupled to the fluid pump using a variable input device. Further, method 600 optionally includes applying a force to a face of the piston from the fluid in the extension pressure chamber to move the piston from a first retracted position to a second extended position.

Figure 7:
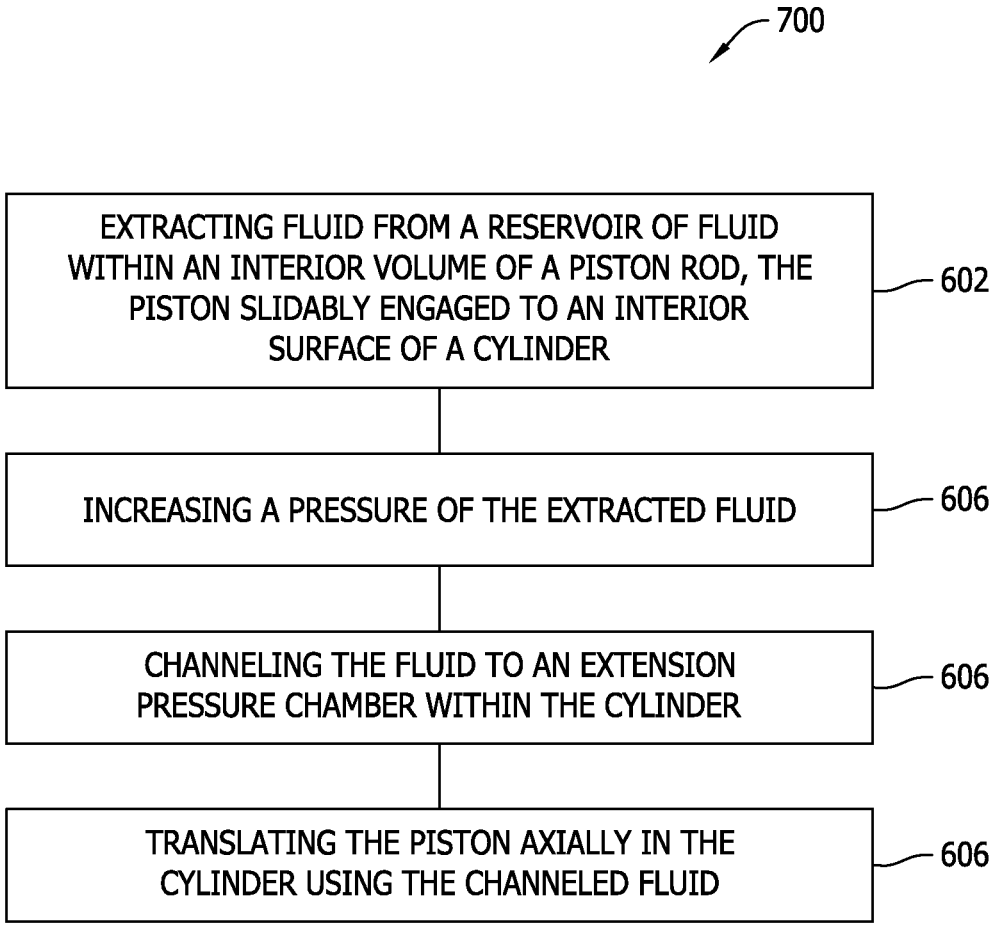
FIG. 7 is a flow diagram of a method of operating a fluid piston-cylinder assembly in accordance with an example embodiment of the present disclosure.

FIG. 7 is a flow diagram of a method 700 of operating a fluid piston-cylinder assembly. In the example embodiment, extracting 702 fluid from a reservoir of fluid within an interior volume of a piston, the piston slidably engaged to an interior surface of a cylinder, increasing 704 a pressure of the extracted fluid, channeling 706 the fluid to an extension pressure chamber within the cylinder, and translating 708 the piston axially in the cylinder using the channeled fluid.

Method 700 optionally includes extracting fluid from the reservoir through a transfer tube that extends at least partially through the reservoir and the extension pressure chamber. Method 700 also optionally includes extracting fluid from the reservoir through a transfer tube that extends coaxially through at least a portion of the reservoir and coaxially through at least a portion of the extension pressure chamber. Moreover, method 700 optionally includes increasing a pressure of the extracted fluid using a variable speed motor coupled to a positive displacement fluid pump While the disclosure has been described in terms of various specific embodiments, it will be recognized that the disclosure can be practiced with modification within the spirit and scope of the claims.

The above-described embodiments of a method and system for a fluid cylinder having an internal reservoir provides a cost-effective and reliable means operating machinery without external tubes or hoses for channeling fluid, such as, but not limited to hydraulic oil. More specifically, the methods and systems described herein facilitate minimizing a possibility of a leakage of hydraulic fluid from a fluid cylinder. In addition, the above-described methods and systems facilitate providing a fluid cylinder in a compact package. As a result, the methods and systems described herein facilitate operating machinery in a cost-effective and reliable manner.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fluid cylinder assembly comprising:

a piston assembly comprising a piston coupled to a piston rod formed of a hollow body, said hollow body comprising an internal fluid reservoir;

a cylinder body coaxial with and at least partially surrounding said hollow piston rod; and a fluid pump driven by an electric motor, a pump suction channel of said fluid pump coupled in flow communication with said internal fluid reservoir through a transfer tube extending through said piston into said internal fluid reservoir, said transfer tube coaxial with said piston, said piston rod, and said cylinder body, a piston face comprising an aperture that slidably engages said transfer tube, a discharge of said fluid pump coupled in flow communication with an extension pressure chamber, said piston positioned between said internal fluid reservoir and said pressure extension chamber.

2. The fluid cylinder assembly of claim 1, further comprising a valve block coupled to a first end of said cylinder body and comprising one or more fluid channels formed therein.

3. The fluid cylinder assembly of claim 2, wherein said valve block comprises said pump suction channel extending between said transfer tube and said fluid pump.

4. The fluid cylinder assembly of claim 2, wherein said valve block comprises a pump discharge channel extending between the discharge of said fluid pump and said extension pressure chamber.

5. The fluid cylinder assembly of claim 4, wherein said pump discharge channel further comprises an extension pressure chamber supply path comprising a check valve.

6. The fluid cylinder assembly of claim 4, wherein said pump discharge channel further comprises a return path comprising a pressure relief valve.

7. The fluid cylinder assembly of claim 1, wherein said extension pressure chamber is defined between said transfer tube and said cylinder body.

8. The fluid cylinder assembly of claim 1, further comprising a variable speed motor coupled to said fluid pump, said variable speed motor configured to drive said fluid pump at different speeds corresponding to different rates of flow of a fluid through said fluid pump.

9. A method of operating a scissors lift assembly, said method comprising:

providing a scissors lift assembly including a work platform, a plurality of linked, folding supports oriented in a crisscross pattern and the fluid cylinder assembly of claim 1 configured to apply a force to raise the work platform;

supplying a variable rate of a flow of a fluid to the extension pressure chamber of the fluid cylinder assembly from the internal fluid reservoir to the piston rod of the piston assembly through the transfer tube that extends through the piston face of the piston assembly using said fluid pump, said fluid pump being a variable speed fluid pump integral to the fluid cylinder assembly, the rate of the flow of the fluid is relative to a selectable speed of the fluid pump, the rate of the flow of the fluid to the extension pressure chamber defining a speed of raising the work platform; and selecting the speed of the fluid pump using a variable input device.

10. The method of claim 9, further comprising bleeding fluid from the extension pressure chamber to the internal fluid reservoir through a selectable size orifice to lower the work platform.

11. The method of claim 10, further comprising controlling the speed of the bleeding using the selectable size orifice.

12. The method of claim 9, wherein selecting the speed of the fluid pump using a variable input device comprises generating a fluid pump speed command signal using a joystick control.

13. The method of claim 9, wherein selecting the speed of the fluid pump using a variable input device comprising selecting a speed of an electric motor coupled to the fluid pump using a variable input device.

14. The method of claim 9, wherein supplying a variable rate of a flow of a fluid to the extension pressure chamber comprises applying a force to the piston face from the fluid in the extension pressure chamber to move the piston assembly from a first retracted position to a second extended position.

15. A method of operating the fluid cylinder assembly of claim 1 comprising:

extracting fluid from the internal fluid reservoir within an interior volume of the hollow piston rod, the piston coupled to the hollow piston rod is slidably engaged to an interior surface of the cylinder body, the transfer tube that extends through said aperture through said piston face;

increasing a pressure of the extracted fluid;

channeling the fluid to the extension pressure chamber within the cylinder body; and translating the piston axially in the cylinder body using the channeled fluid.

16. The method of claim 15, wherein extracting fluid from the internal fluid reservoir within an interior volume of the hollow piston rod comprises extracting fluid from the internal fluid reservoir through said transfer tube that extends at least partially through the internal fluid reservoir and the extension pressure chamber.

17. The method of claim 15, wherein extracting fluid from the internal fluid reservoir within an interior volume of the hollow piston rod comprises extracting fluid from the internal fluid reservoir through a transfer tube that extends coaxially through at least a portion of the internal fluid reservoir and coaxially through at least a portion of the extension pressure chamber.

18. The method of claim 15, wherein increasing a pressure of the extracted fluid comprises increasing a pressure of the extracted fluid using said electric motor coupled to said fluid pump, said fluid pump being a positive displacement pump.

19. A fluid cylinder assembly comprising:

a fluid pump;

a cylinder body comprising an inner surface and a pressure extension chamber coupled in flow communication with a pump discharge channel of said fluid pump;

a piston assembly comprising:

a piston rod comprising an internal fluid reservoir coupled in flow communication with a pump suction channel of said fluid pump through a transfer tube; and a piston face coupled to said piston rod, said piston face slidably engaged to said inner surface, said piston face slidably engaged to said transfer tube extending between said internal fluid reservoir and said pump suction channel, a piston positioned between said internal fluid reservoir and said pressure extension chamber.

* * * * *